US007227162B2

(12) United States Patent
Barrett et al.

(10) Patent No.: US 7,227,162 B2
(45) Date of Patent: Jun. 5, 2007

(54) METHOD AND APPARATUS FOR PROVIDING TUNING OF SPECTRAL OUTPUT FOR COUNTERMEASURE DEVICES

(75) Inventors: John L. Barrett, Pelham, NH (US); Peter A. Ketteridge, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 74 days.

(21) Appl. No.: 11/056,856

(22) Filed: Feb. 11, 2005

(65) Prior Publication Data

US 2007/0057205 A1 Mar. 15, 2007

(51) Int. Cl.
*A61N 5/06* (2006.01)

(52) U.S. Cl. ..... 250/504 R; 250/493.1; 250/494.1; 250/495.1; 250/365

(58) Field of Classification Search ..... None
See application file for complete search history.

(56) References Cited

U.S. PATENT DOCUMENTS

| | | | | |
|---|---|---|---|---|
| 5,611,870 | A * | 3/1997 | Horne et al. | 136/253 |
| 5,838,016 | A | 11/1998 | Johnson | 250/504 |
| 6,249,005 | B1 | 6/2001 | Johnson | 250/504 |
| 6,611,085 | B1 * | 8/2003 | Gee et al. | 313/271 |
| 2003/0034065 | A1 * | 2/2003 | Meulenberg | 136/253 |
| 2003/0218143 | A1 * | 11/2003 | Shields et al. | 250/493.1 |
| 2006/0180740 | A1 * | 8/2006 | Barrett et al. | 250/207 |

* cited by examiner

*Primary Examiner*—Nikita Wells
(74) *Attorney, Agent, or Firm*—Hayes Soloway PC

(57) ABSTRACT

A countermeasure device includes an emitter having a surface. A band gap material is integral with the surface of the emitter. A series of apertures are formed in the band gap material. A heat source for heating the emitter is provided proximate to the emitter and may be the metal surface itself. When the emitter is heated, the band gap material, and the apertures therein, allows the emitter to emit photons at predetermined wavelengths.

19 Claims, 8 Drawing Sheets

METHOD AND APPARATUS FOR PROVIDING TUNING OF SPECTRAL OUTPUT FOR COUNTERMEASURE DEVICES

FIELD OF THE INVENTION

The present invention relates to ordnance and more particularly to methods and apparatus for providing shielding from fast moving projectiles.

BACKGROUND OF THE INVENTION

Various methods and apparatus exist for shielding or protecting potential targets, including surface vehicles, target, gun emplacements, ships, troop concentrations, and the like from projectiles.

One such protective apparatus uses devices containing emitter tubes to ward off threat projectiles. The devices are mounted in various locations on an exterior of a plane, normally. Each device heats an emitter tube to high temperatures, sometimes in the vicinity of 750 Kelvin. Once heated, the emitter tube begins to decay, emitting photons in the process. FIG. 1 is a graph of an example of the spectral radiant emissions from an emitter tube heated to a temperature of 750 Kelvin.

Threat projectiles are generally designed to seek emissions typical to targets. Typical target emissions include photons of 2–5 microns wavelength, some of which is quickly absorbed in the atmosphere, but some of which is not. Threat projectiles can be designed to seek out those photon emission wavelengths that are typical to targets and that are not typically quickly absorbed into the atmosphere.

The emissions from the heated emitter tubes tend to cloud the target, sometimes blinding the threat projectile from its target. FIG. 2 is an exemplary embodiment of a target 10 protected by emitter photon emissions. Surrounding the target 10 is a "zone of protection" 12 created by the emitter photon emissions. A threat missile fired into the "zone of protection" 12 will have its heat sensor, which is attempting to sense the photon emission from the target propulsion system, clouded by the emitter photon emissions and will typically fail to hit its target. Toward the rear of the target 10, in this embodiment, is the target propulsion system 14, the source of the photon emissions for targets. One of the limitations of the emitter tubes is that they fail to emit sufficient photons in the wavelengths sought by the threat projectiles to blind the projectiles at the target propulsion system 14. In other words, the "zone of protection" 12 does not extend to the location of the target propulsion system 14. As a result, a threat projectile fired from behind the target 10 may strike the target 10 without ever passing into the "zone of protection" 12. This problem is one of several encountered using the emitter tube system.

Another problem with the emitter tube system is robustness. The emitter tubes will produce photons in sufficient number for a short time period while operating at required levels. After this period of time passes, the emitter tubes need to be replaced, which typically requires the target to be on the ground. Most targets using this system will discard emitter tubes after a the period above minus a margin period in part because an target that requires a "zone of protection" does not want to have the emitter tubes expire while the target is airborne. A target defense system is needed that does not require such frequent maintenance.

Another problem with the emitter tube system is efficiency. Threat projectiles are typically targeting specific bands of photon wavelength emission. The wavelengths of these bands, known as "threat bands", are all between 1.5 and 5 microns. However, combined, the threat bands are approximately 2 microns wide. As can be seen from FIG. 1, typical effective wavelength emissions from the emitter tube system are approximately 7–8 microns wide. Therefore, most of the emissions from the emitter tubes are not impacting the bands of photon wavelength emissions sought by the threat projectiles and those emissions are being wasted. Preferably, a target defense system could be designed that wasted less energy.

Another problem with the emitter tube system is scalability. FIG. 3 is a graph of an example of the spectral radiant emissions from an emitter tube heated at a temperature above 750 Kelvin. As can be seen by FIG. 3, as compared to FIG. 1, the peak of the curve shifts to the left as the temperature of emitter tube increases. A band of some interest in projectile defense is the approximately 2–5 micron wavelength band. As can be seen by FIG. 3, as compared to FIG. 1, even as more power is used to heat the emitter tube to a higher temperature, the photon emissions in the 2–5 micron wavelength band decrease. Ideally a projectile defense system would increase photon emissions in the 2–5 micron wavelength band as power to the system is increased (i.e., be scalable).

Thus, a heretofore unaddressed need exists in the industry to address the aforementioned deficiencies and inadequacies.

SUMMARY OF THE INVENTION

Embodiments of the present invention provide a system and method for controlling the spectral output of a countermeasure device. Briefly described in architecture, one embodiment of the system, among others, can be implemented as follows. A countermeasure device includes an emitter having a surface. A band gap material is integral with the surface of the emitter. A series of apertures are formed in the band gap material and a heat source for heating the emitter is provided proximate to the emitter.

In another aspect, the invention features a method of making a countermeasure device having a controlled spectral output. The method includes the steps of: forming an emitter having a surface; integrating a band gap material with the surface of the emitter; locating a heat source proximate to the emitter; and creating a series of apertures in the band gap material.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 4:
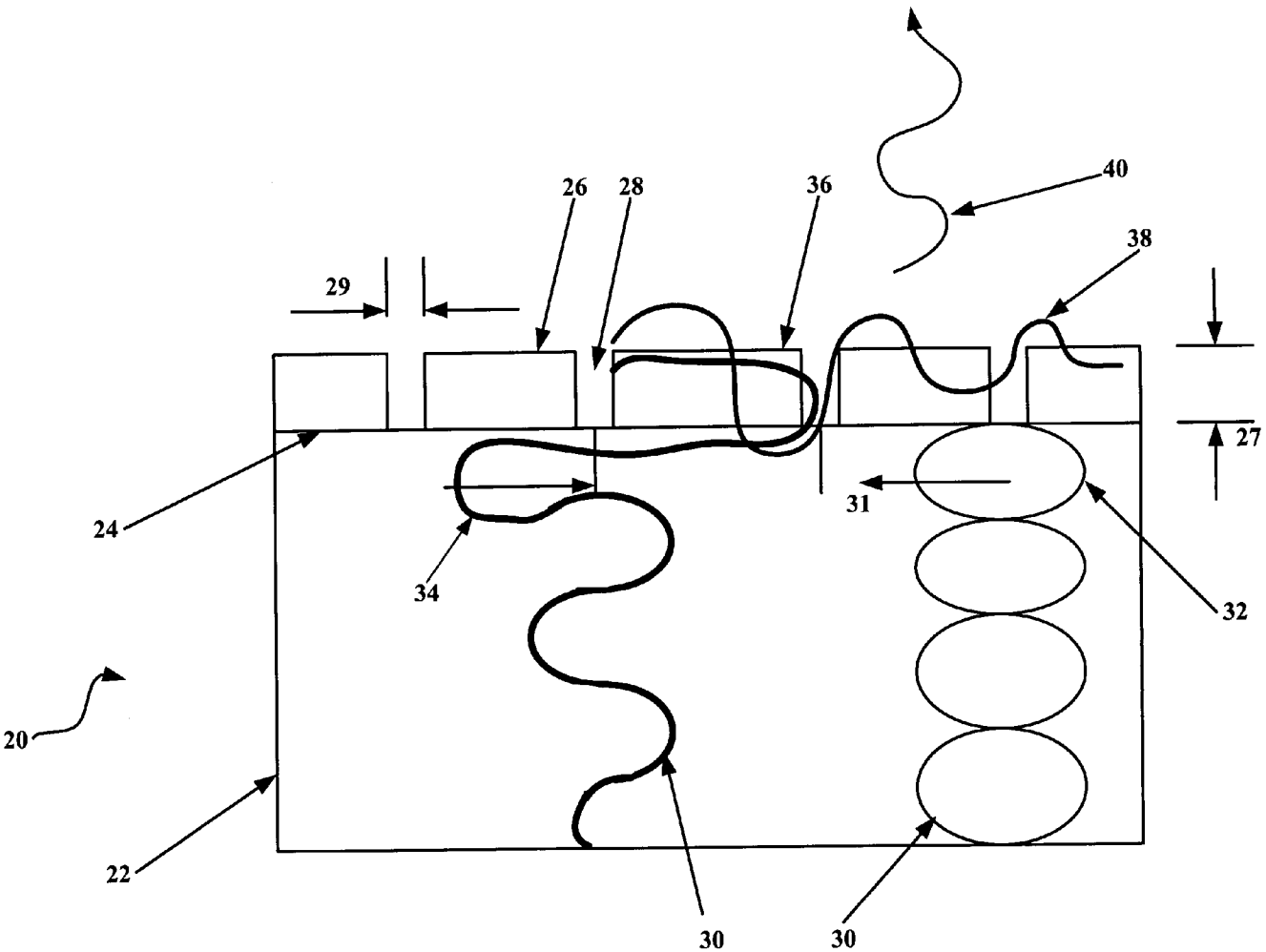
FIG. 4 shows a portion of cross-section of an exemplary photon band gap spectral emitter in accordance with the principles of the invention.

An exemplary photon band gap spectral emitter 20 that is part of the basis for the present invention is illustrated in FIG. 4. FIG. 4 is a portion of cross-section of an emitter 22 having a band gap material 26 integral with a surface 24 of the emitter 22. The band gap material 26 has a series of apertures 28. Physics teaches that when a body is thermally excited that body will emit energy. That energy can be described as photons over a wavelength band. The radiance and wavelength of the energy will be affected by a number of factors, such as the temperature to which the body is thermally excited. When the emitter 22 is thermally excited, the emitter 22 begins creating thermally excited outputs 30.

In the example shown in FIG. 4, the band gap material 26 restricts some of the thermally excited outputs 30 from being emitted from the thermally excited emitter 22. The restricted thermally excited outputs 32 reflect back from the surface 24 and the band gap material 26. The unrestricted thermally excited outputs 34 are released into a band gap surface 36, where the unrestricted thermally excited outputs 34 become part of surface plasmons 38. As the surface plasmons 38 decay, they are released as emitted photons 40. In this example, the thickness 27 of the band gap material 26, the size 29 of the apertures 28, and the distance 31 between the apertures 28 impact the wavelengths of the emitted photons 40. The wavelength of emitted photons 40 from the photon band gap spectral emitter 20 are not significantly impacted by the temperature of the emitter 22.

The restricted thermally excited outputs 32 do not become wasted energy. Instead, after reflecting within the emitter 22 for a period of time, the restricted thermally excited outputs 32 bleed into the unrestricted thermally excited outputs 34. Following the same course as the unrestricted thermally excited outputs 34, the restricted thermally excited outputs 32 eventually become part of the emitted photons 40, exhibiting the similar wavelengths to the unrestricted thermally excited outputs 34. In this regard, the band gap material 26 does not simply filter thermally excited outputs 30 for emitted photons of desired wavelengths. Instead, as explained further hereafter, the band gap material 26 also helps to convert the thermally excited outputs 30 that would otherwise become emitted photons 40 of undesired wavelengths into emitted photons 40 of desired wavelengths, thus conserving the output of thermal energy.

Figure 1:
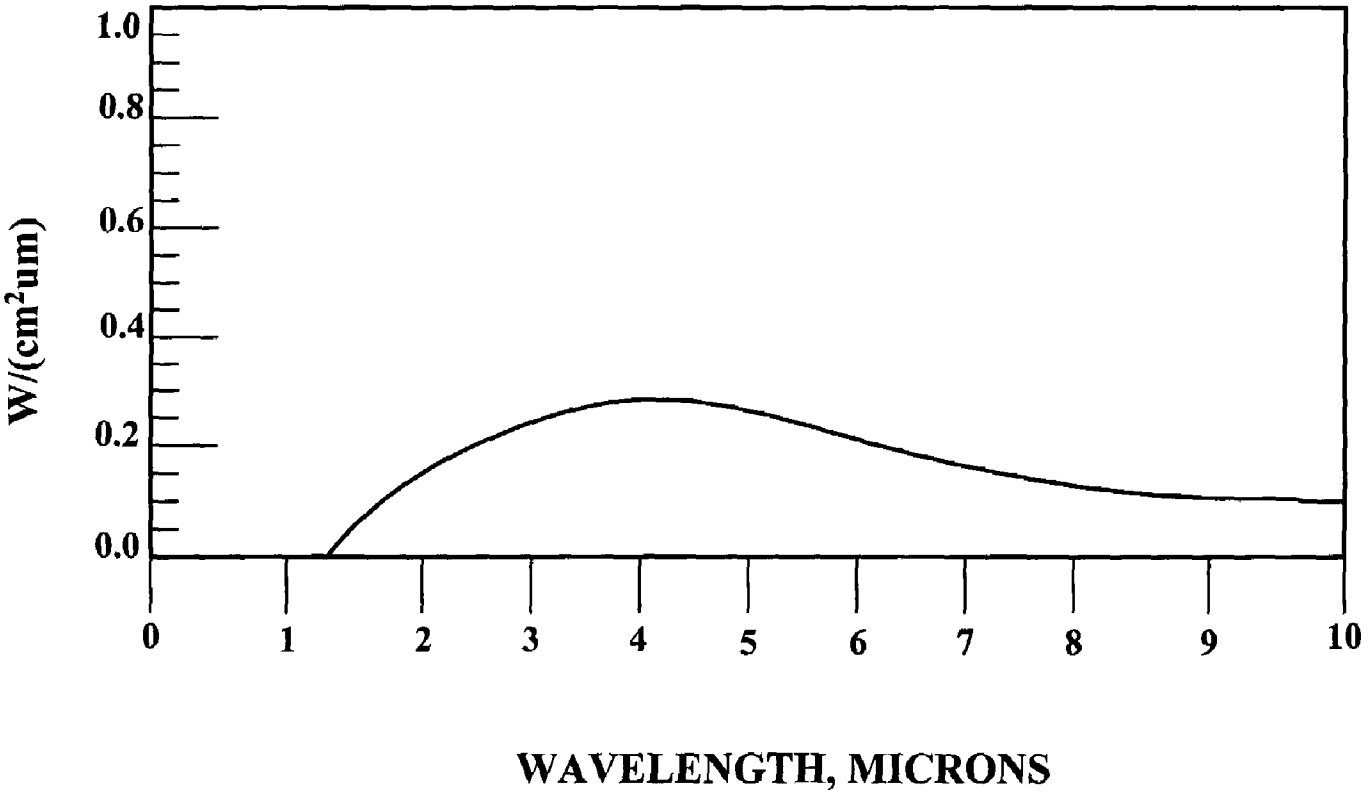
FIG. 1 (Prior Art)
FIG. 1 is a graph of a prior art example of the spectral radiant emissions from an emitter tube heated to a temperature of 750 Kelvin.
Figure 2:
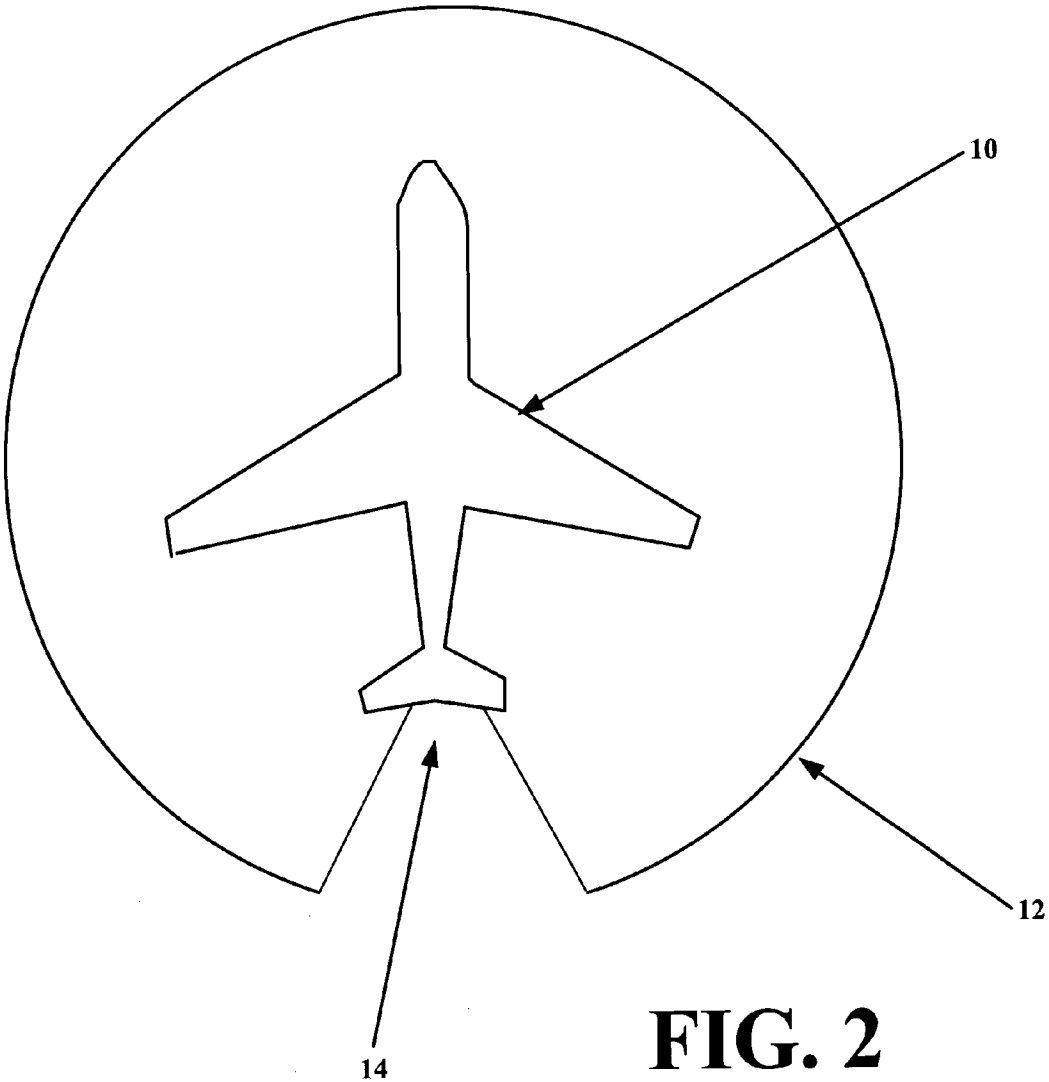
FIG. 2 (Prior Art)
FIG. 2 is a prior art exemplary embodiment of a target protected by emitter emissions.
Figure 3:
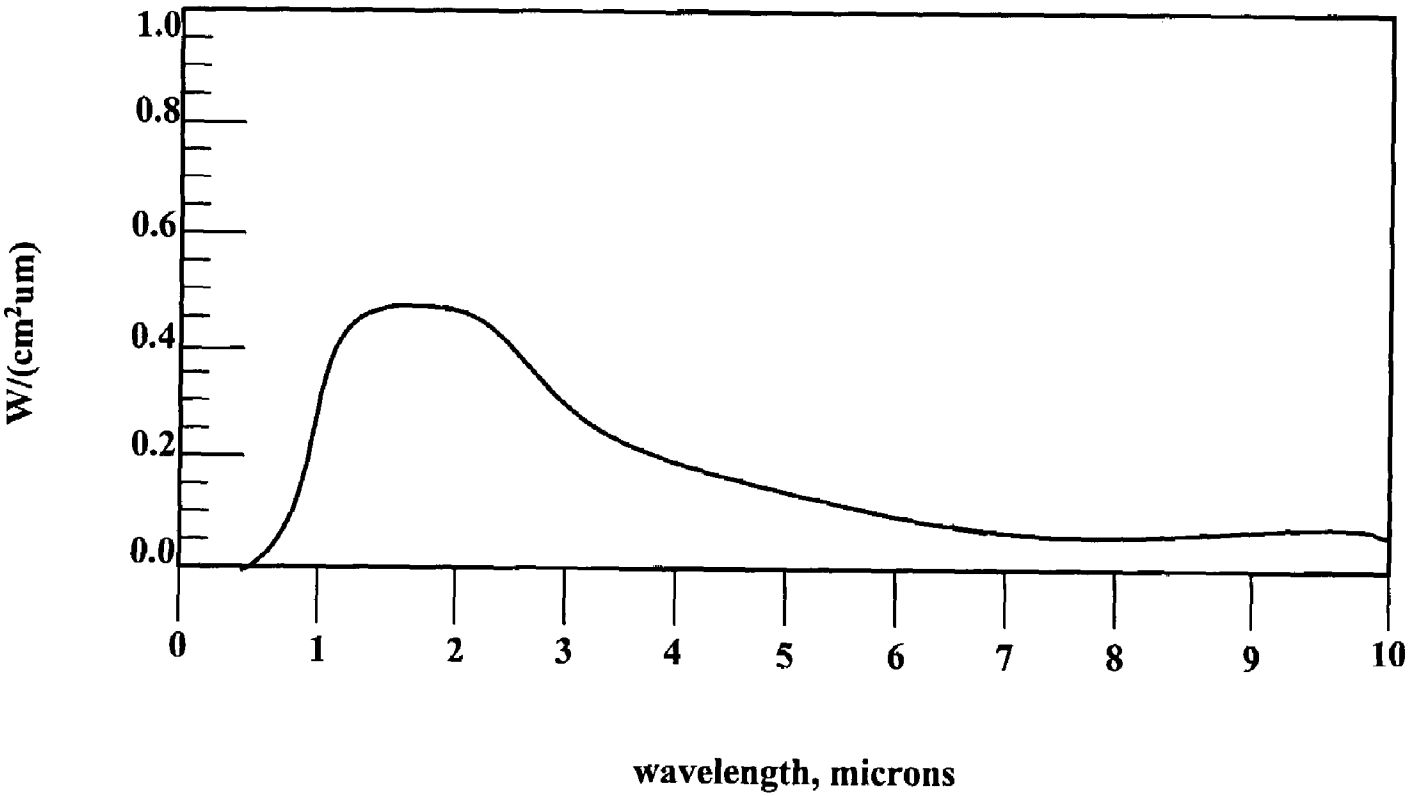
FIG. 3 (Prior Art)
FIG. 3 is a graph of a prior art example of the spectral radiant emissions from an emitter tube heated at a temperature above 750 Kelvin.
Figure 5:
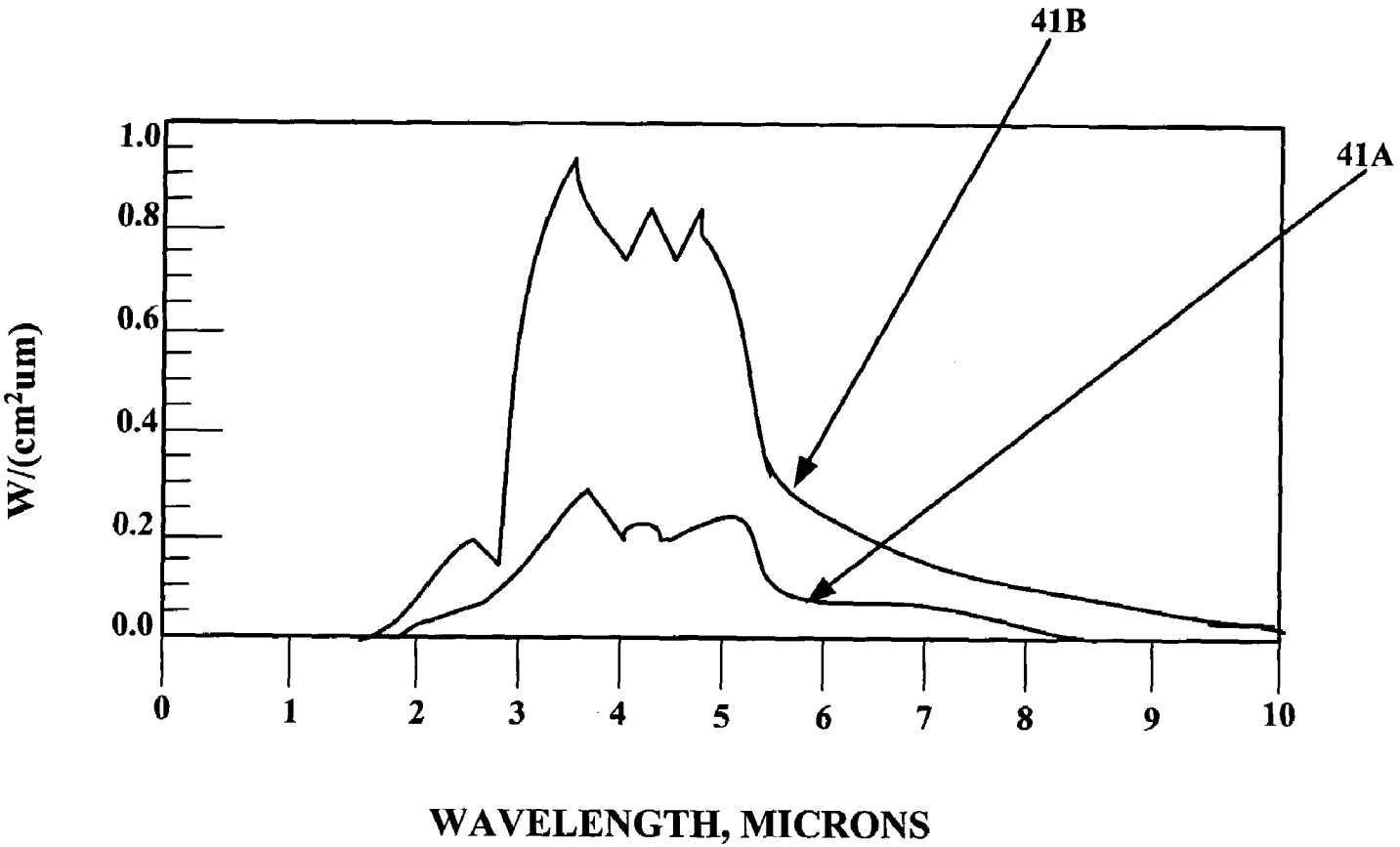
FIG. 5 is a graph of an example of the spectral radiant emissions from the exemplary photon band gap spectral emitter of FIG. 4.

FIG. 5 illustrates an example of the properties of the emitted photons 40 from the exemplary photon band gap spectral emitter 20 shown in FIG. 4. The graph contains emission curves for two different temperatures, 600 Kelvin—and 720 Kelvin 41B, of the emitter 22 in the exemplary photon band gap spectral emitter 20. For illustrative purposes, wavelength of the emitted photons 40 for the exemplary photon band gap spectral emitter 20 was made to be primarily between approximately 3 and 5 microns. Of course, the photon band gap spectral emitter 20, as disclosed herein, can be used to emit photons at other wavebands and/or multiple wavebands. As previously discussed, the thickness 27 of the band gap material 26, the size 29 of the apertures 28, and the distance 31 between the apertures 28 impact the wavelengths of the emitted photons 40. However, unlike other thermally excited bodies, the wavelength of emitted photons 40 are not prohibitively impacted by the temperature of the emitter 22. Hence, the significant portion of the emitted photons 40 for this example will remain between approximately 3 and 5 microns, regardless of the temperature to which the emitter 22 is heated. This characteristic makes the photon band gap spectral emitter 20 scalable. It can also be seen, comparing FIG. 5 to FIG. 1, that the photon band gap spectral emitter 20 is capable of significantly greater output at the desired wavelengths with lower heat (input energy) requirements. This difference is directly related to the band gap material 26 working to restrict some of the thermally excited output 30, which would otherwise become emitted photons 40 having undesirable wavelengths, until it bleeds into unrestricted thermally excited output 34 and becomes emitted photons 40 at desirable wavelengths.

Figure 6:
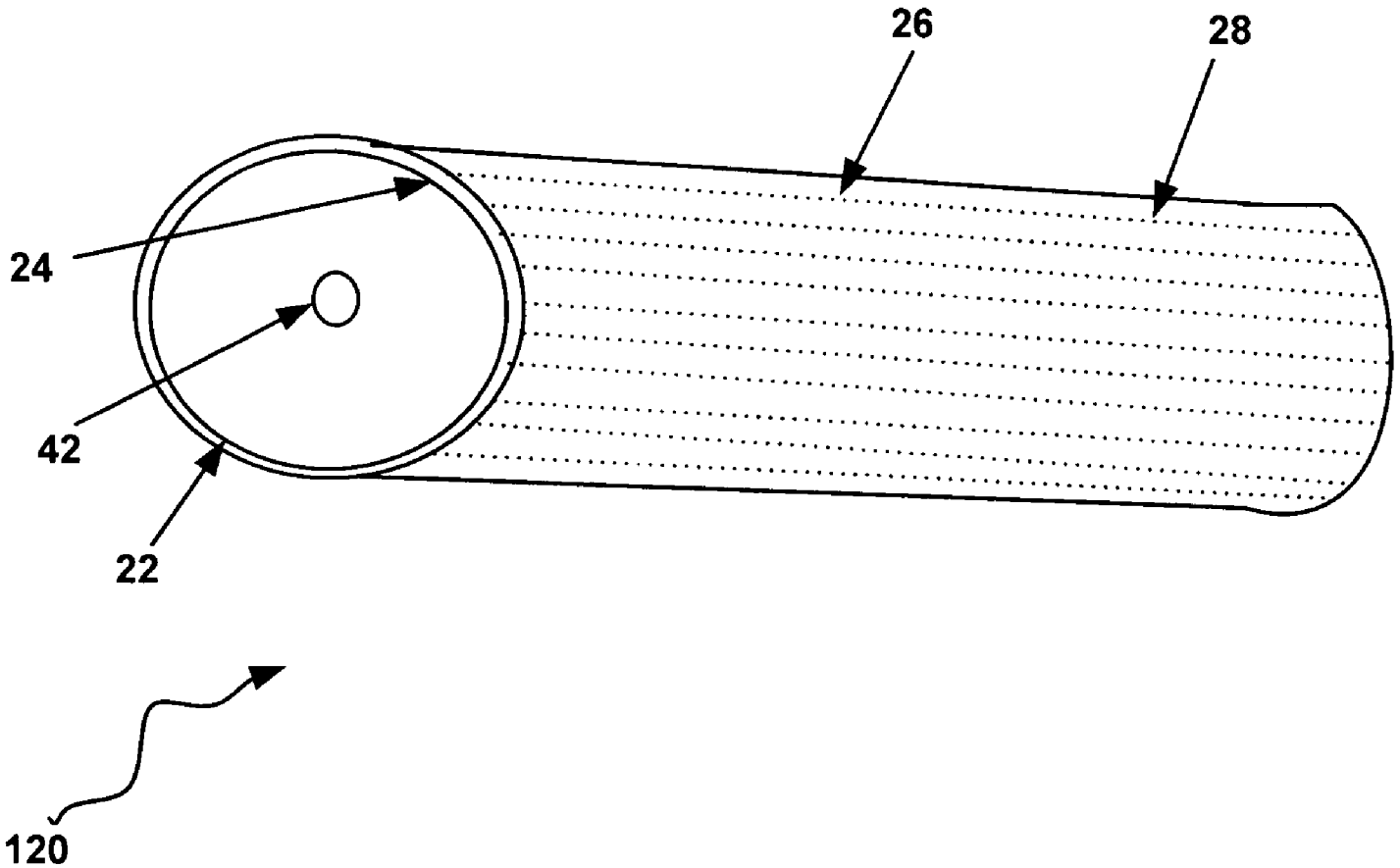
FIG. 6 is a perspective view of a first exemplary embodiment of the invention.
Figure 7:
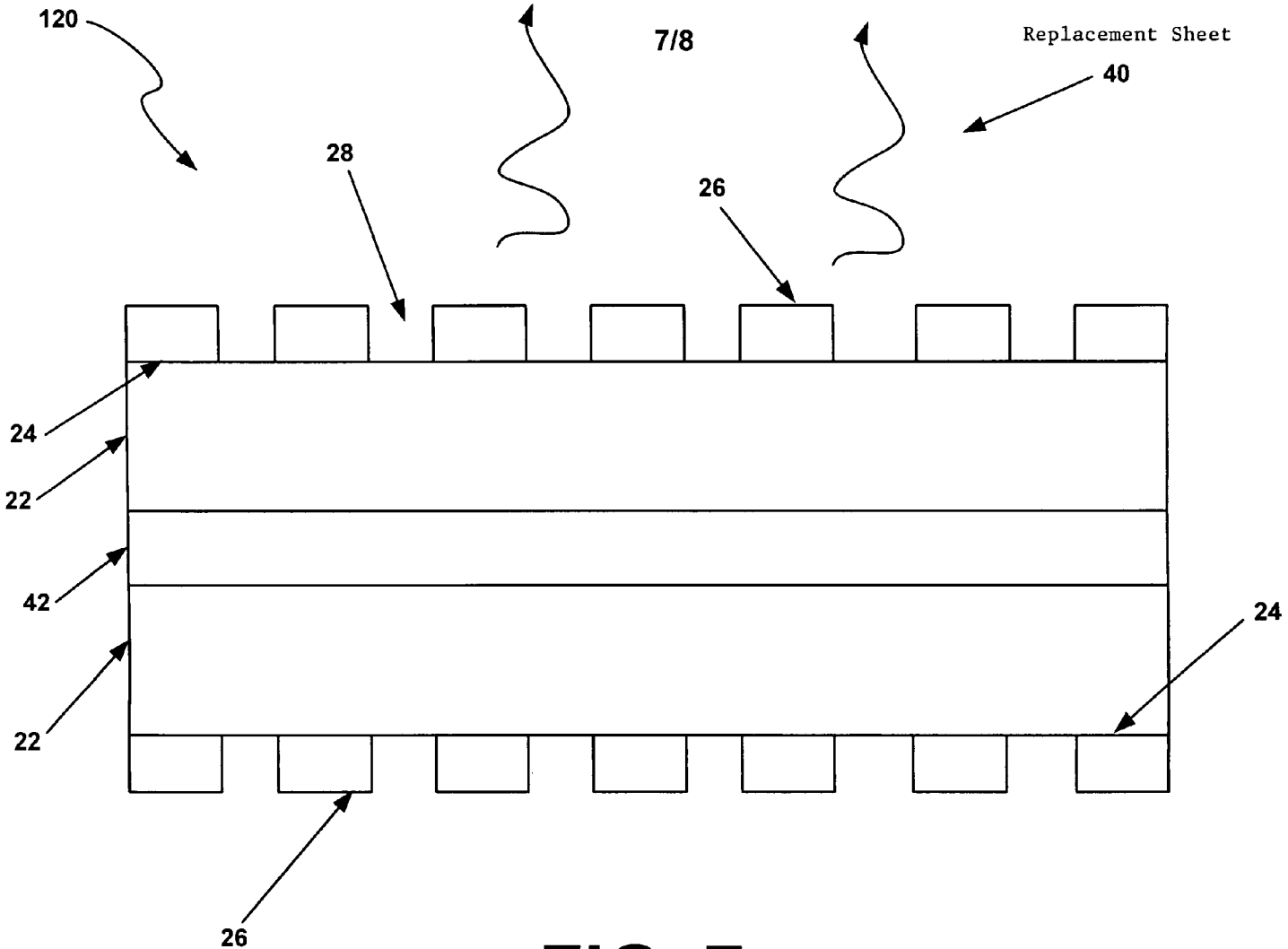
FIG. 7 is a cross-sectional view of a portion of the invention shown in FIG. 6, in accordance with the first exemplary embodiment of the invention.

A countermeasure device 120, in accordance with a first exemplary embodiment of the invention, is shown in FIG. 6 and FIG. 7. FIG. 6 is a perspective view of the first exemplary embodiment of the invention. FIG. 7 is a cross-sectional view of a portion of the invention shown in FIG. 6, in accordance with the first exemplary embodiment of the invention. A countermeasure device 120 includes the emitter 22 having the surface 24. The band gap material 26 is integral with the surface 24 of the emitter 22. The series of apertures 28 are formed in the band gap material 26. A heat source 42 for heating the emitter 22 is provided proximate to the emitter 22.

Material for the emitter 22 and the band gap material 26 may be selected based on its ability to withstand temperatures of at least 600 Kelvin without significant degradation. One robust material that may be used for the emitter 22 is silicon. Of course, other types of material may be used, depending on the ability of the material to withstand temperatures without significant degradation and a need for the material to withstand degradation. Certainly, disposable applications for the countermeasure device 120 will not require as robust an emitter 22. The band gap material 26 may be a type of metal. Of course, other types of material may be utilized as the band gap material 26, depending on the thermal and electrical conductivity of the material and the ability of the material to restrain thermally excited outputs 30.

The apertures 28 in the series of apertures 28 may be periodically spaced. Research has suggested that spacing of the apertures 28 may directly impact the wavelength band of emitted photons 40. The apertures 28 in the series of apertures 28 may also be consistently sized. Research has suggested that the sizing of the apertures 28 may directly impact the wavelength band of emitted photons 40. For instance, apertures 28 consistently sized at approximately 3 microns in diameter and spaced approximately 5 microns apart (center-to-center) may produce emitted photons 40 in the wavelength band of 3–5 microns, as shown in FIG. 5. Thickness of the band gap material 26 may further influence the wavelength band of emitted photons 40.

Operation of the countermeasure device 120 requires the emitter 22 to be heated. The emitter 22 may be heated to at least 500 Kelvin, which will produce some emitted photons 40. The emitter 22 may be heated to at least 700 Kelvin, which will produce significant emitted photons 40, as shown in FIG. 5.

The countermeasure device 120 may substantially limit emitted photons 40 to a wavelength band approximately between 1.5 micron and 5.0 micron. Limiting emitted photons 40 to this wavelength band allows protection over all threat bands while efficiently directing energy. The countermeasure device 120 may instead be designed to target multiple wavelength bands, targeting each of the threat bands and further increasing efficiency of the countermeasure device 120.

Figure 8:
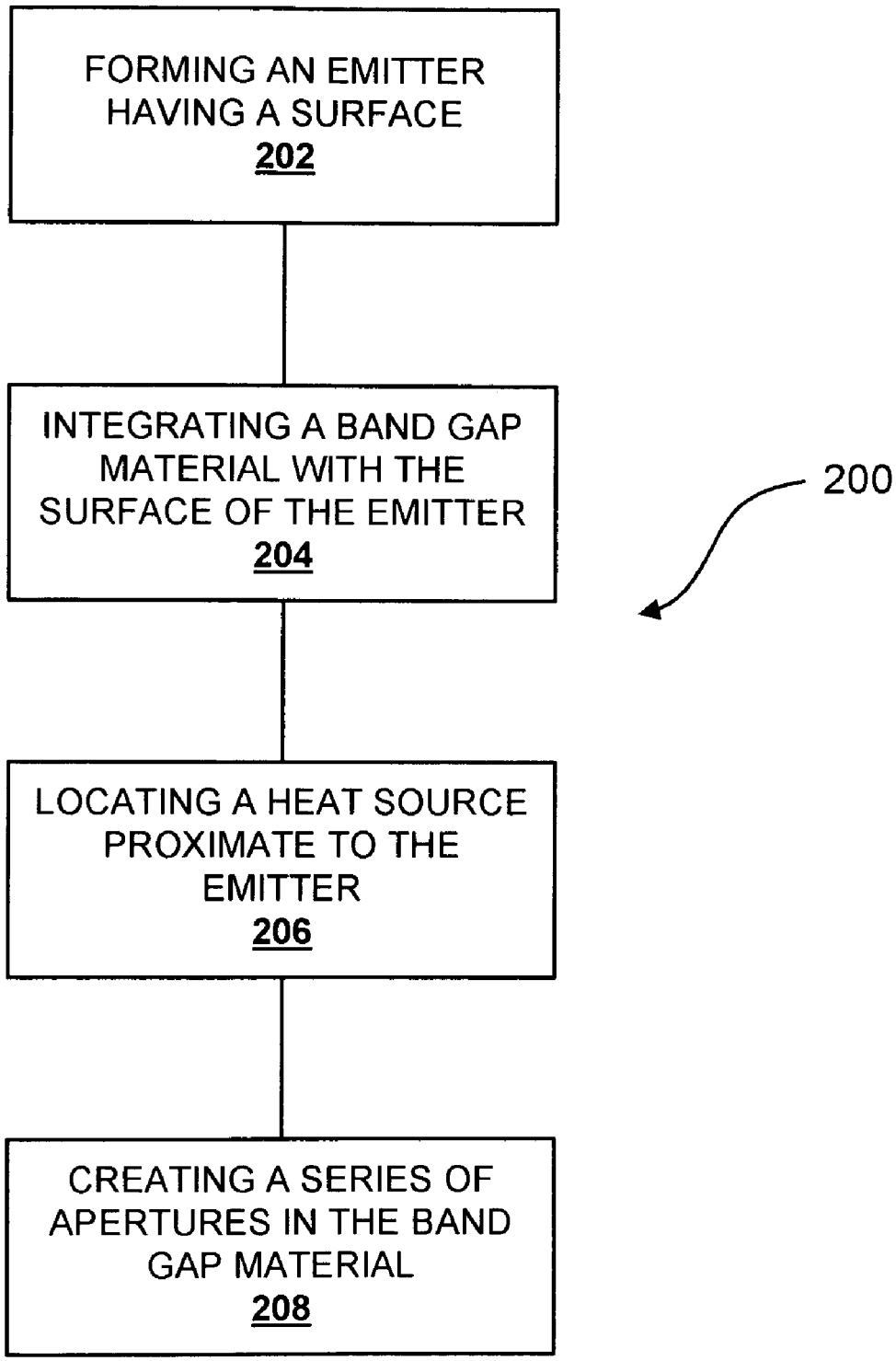
FIG. 8 is a flow chart illustrating one method of making the invention shown in FIG. 7, in accordance with the first exemplary embodiment of the present invention.

The flow chart of FIG. 8 shows the functionality and operation of a possible implementation of the countermeasure device 120. In this regard, each block represents a module, segment, or step, which comprises one or more instructions for implementing the specified function. It should also be noted that in some alternative implementations, the functions noted in the blocks might occur out of the order noted in FIG. 8. For example, two blocks shown in succession in FIG. 8 may in fact be executed non-consecutively, substantially concurrently, or the blocks may sometimes be executed in the reverse order, depending upon the functionality involved, as will be further clarified herein.

FIG. 8 shows a flow chart illustrating a method 200 for making a countermeasure device 120. The method 200 involves forming the emitter 22 having the surface 24 (block 202). The band gap material 26 is integrated with the surface 24 of the emitter 22 (block 204). The heat source 42 is located proximate to the emitter 22 (block 206). The series of apertures 28 is created in the band gap material 26 (block 208).

Those having ordinary skill in the art will recognize there are a number of ways to integrate the band gap material 26 with the surface 24 of the emitter 22. The band gap material 26 may be deposited on the emitter 22, may be fabricated on the emitter 22 or may be integrated with the emitter 22 by some other means.

The heat source 42 may be mounted proximate to the emitter 22. Mounting the heat source 42 proximate to the emitter 22 may involve mounting the heat source 42 directly to the emitter 22. In addition, mounting the heat source 42 proximate to the emitter 22 may involve running current through the emitter 22 or a portion of the emitter 22 and generating current resistive heat. As shown in FIG. 6 and FIG. 7, mounting the heat source 42 may also involve mounting a heat source 42 within the emitter 22. Those having ordinary skill in the art will recognize a number of other possibilities exist for providing a heat source 42 for the emitter 22. The heat source 42 may be sufficient to heat the emitter 22 to at least 500 Kelvin. The heat source 42 may be sufficient to heat the emitter 22 to at least 700 Kelvin.

It should be emphasized that the above-described embodiments of the present invention are merely possible examples of implementations, simply set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and protected by the following claims.

We claim:

1. A countermeasure device for emitting predetermined bands of photons, the device comprising:

an emitter having a surface;

a metal band gap material integral with the surface of the emitter, wherein the metal band gap material substantially encompasses the emitter;

a series of apertures formed in the band gap material; and a heat source proximate to the emitter thereby heating the emitter.

2. The countermeasure device of claim 1, wherein the emitter and the band gap material can withstand temperatures of at least 600 Kelvin without significant degradation.

3. The countermeasure device of claim 1, wherein each of the apertures in the series of apertures is periodically spaced.

4. The countermeasure device of claim 1, wherein each of the apertures in the series of apertures is equivalently sized.

5. The countermeasure device of claim 1, wherein the emitter is heated to at least 500 Kelvin.

6. The countermeasure device of claim 1, wherein the emitter is heated to at least 700 Kelvin.

7. The countermeasure device of claim 1, further comprising an emission substantially limited wavelengths approximately between 1.5 micron and 5.0 micron.

8. The countermeasure device of claim 1, further comprising thermally excited output generated by the heated emitter, the thermally excited output having at least one desired waveband and at least one non-desired waveband, and wherein the metal band gap material reflects the non-desired waveband of thermally excited output from the heated emitter, thereby entrapping the non-desired waveband of thermally excited output within the heated emitter until the non-desired waveband of thermally excited output bleeds into the desired waveband of thermally excited output.

9. A method for making a countermeasure device, the method comprising the steps of:

forming an emitter having an outer surface;

integrating a metal band gap material with a substantial portion of the outer surface of the emitter;

locating a heat source proximate to the emitter; and creating a series of apertures in the band gap material.

10. The method of claim 9, wherein the step of integrating a band gap material further comprises depositing a band gap material on the outer surface of the emitter.

11. The method of claim 9, wherein the step of creating a series of apertures further comprises creating a series of periodically spaced apertures.

12. The method of claim 9, wherein the step of creating a series of apertures further comprises creating a series of apertures wherein each aperture is substantially equivalently sized.

13. The method of claim 9, wherein the step of locating a heat source proximate to the emitter further comprises mounting a heat source to the emitter.

14. The method of claim 9, further comprising heating the emitter to a temperature of at least 500 Kelvin.

15. The method of claim 9, further comprising heating the emitter to a temperature of at least 700 Kelvin.

16. A system for emitting predetermined wavebands of photons, the system comprising:

an emitter for producing thermally excited output;

a heat source for heating the emitter; and a metal band gap material for selectively receiving the predetermined wavebands of thermally excited output and converting the thermally excited output to emitted photons, the band gap material further reflecting non-predetermined wavebands of thermally excited output within the emitter until non-predetermined wavebands of thermally excited output bleed into the predetermined wavebands of thermally excited output.

17. The system of claim 16, wherein the band gap material is a metal.

18. The system of claim 16, wherein the series of apertures further comprising a series of periodically spaced apertures for selecting the thermally excited output to be converted by the band gap material.

19. The system of claim 16, wherein the series of apertures further comprising a series of substantially equivalently-sized apertures for selecting the thermally excited output to be converted by the band gap material.

* * * * *